US011865423B1

(12) United States Patent
Holliday

(10) Patent No.: US 11,865,423 B1
(45) Date of Patent: Jan. 9, 2024

(54) FOOTBALL PLAYER-WORN TARGET PAD

(71) Applicant: Myles Holliday, Toledo, OH (US)

(72) Inventor: Myles Holliday, Toledo, OH (US)

( * ) Notice: Subject to any disclaimer, the term of this patent is extended or adjusted under 35 U.S.C. 154(b) by 0 days.

(21) Appl. No.: 17/700,616

(22) Filed: Mar. 22, 2022

(51) Int. Cl.

| | |
|---|---|
| ***A63B 69/34*** | (2006.01) |
| ***A63B 69/00*** | (2006.01) |
| ***A41D 13/00*** | (2006.01) |
| *A63B 71/06* | (2006.01) |

(52) U.S. Cl.
CPC ..... *A63B 69/002* (2013.01); *A41D 13/0015* (2013.01); *A63B 2071/0694* (2013.01); *A63B 2243/007* (2013.01)

(58) Field of Classification Search
CPC ..... A63B 69/002; A63B 2071/0694; A63B 2243/007; A41D 13/0015
USPC ..... 473/441, 438
See application file for complete search history.

(56) References Cited

U.S. PATENT DOCUMENTS

| | | | | |
|---|---|---|---|---|
| 2,574,046 | A | 11/1951 | Logan | |
| 3,867,726 | A * | 2/1975 | Owl | A63B 71/12 2/462 |
| 4,667,954 | A | 5/1987 | McCorkle | |
| 6,543,775 | B1 * | 4/2003 | Bell, Jr. | A63B 43/005 273/DIG. 30 |
| 7,056,238 | B1 | 6/2006 | Brown | |
| 7,900,274 | B2 * | 3/2011 | Chatman | A63B 71/12 2/463 |
| D745,218 | S * | 12/2015 | Manley | D29/101.4 |
| 9,616,310 | B2 | 4/2017 | Manley | |
| 10,682,558 | B2 * | 6/2020 | Thompson | A63B 69/0059 |
| 10,835,795 | B1 | 11/2020 | Wilson | |
| 10,898,776 | B1 * | 1/2021 | Arza | A63B 69/0059 |
| 2010/0304901 | A1 * | 12/2010 | Sinnott | A63B 69/00 473/438 |
| 2010/0323824 | A1 * | 12/2010 | Gamboa | A63B 69/00 473/438 |
| 2012/0291187 | A1 * | 11/2012 | Hawthorne, Jr. | A63B 71/12 2/463 |
| 2013/0185852 | A1 | 7/2013 | Vince | |
| 2020/0205490 | A1 * | 7/2020 | Williams | B32B 5/028 |
| 2022/0001257 | A1 * | 1/2022 | Rolle | A63B 71/14 |

FOREIGN PATENT DOCUMENTS

| | | |
|---|---|---|
| WO | 2015027045 | 2/2015 |

* cited by examiner

*Primary Examiner* — Mitra Aryanpour
(74) *Attorney, Agent, or Firm* — Kyle A. Fletcher, Esq.

(57) ABSTRACT

The football player-worn target pad is a training device. The football player-worn target pad is a garment. The football player-worn target pad is worn by an athlete. The football player-worn target pad is configured for use in training for the game of American football. The football player-worn target pad provides targets used to aim the interpersonal impacts that commonly occur between a first athlete and a second athlete participating in American football. The football player-worn target pad incorporates a harness structure and a pad structure. The harness structure is worn by the first athlete. The pad structure presents a plurality of target images that are visible to the second athlete. The second athlete aims at the plurality of target images during the interpersonal impact between the second athlete and the first athlete.

11 Claims, 4 Drawing Sheets

FOOTBALL PLAYER-WORN TARGET PAD

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of training apparatus for American style football. (A63B69/002)

SUMMARY OF INVENTION

The football player-worn target pad is a training device. The football player-worn target pad is a garment. The football player-worn target pad is worn by an athlete. The football player-worn target pad is configured for use in training for the game of American football. The football player-worn target pad provides targets used to aim the interpersonal impacts that commonly occur between a first athlete and a second athlete participating in American football. The football player-worn target pad comprises a harness structure and a pad structure. The harness structure is worn by the first athlete. The pad structure presents a plurality of target images that are visible to the second athlete. The second athlete aims at the plurality of target images during the interpersonal impact between the second athlete and the first athlete.

These together with additional objects, features and advantages of the football player-worn target pad will be readily apparent to those of ordinary skill in the art upon reading the following detailed description of the presently preferred, but nonetheless illustrative, embodiments when taken in conjunction with the accompanying drawings.

In this respect, before explaining the current embodiments of the football player-worn target pad in detail, it is to be understood that the football player-worn target pad is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the football player-worn target pad.

It is therefore important that the claims be regarded as including such equivalent construction insofar as they do not depart from the spirit and scope of the football player-worn target pad. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
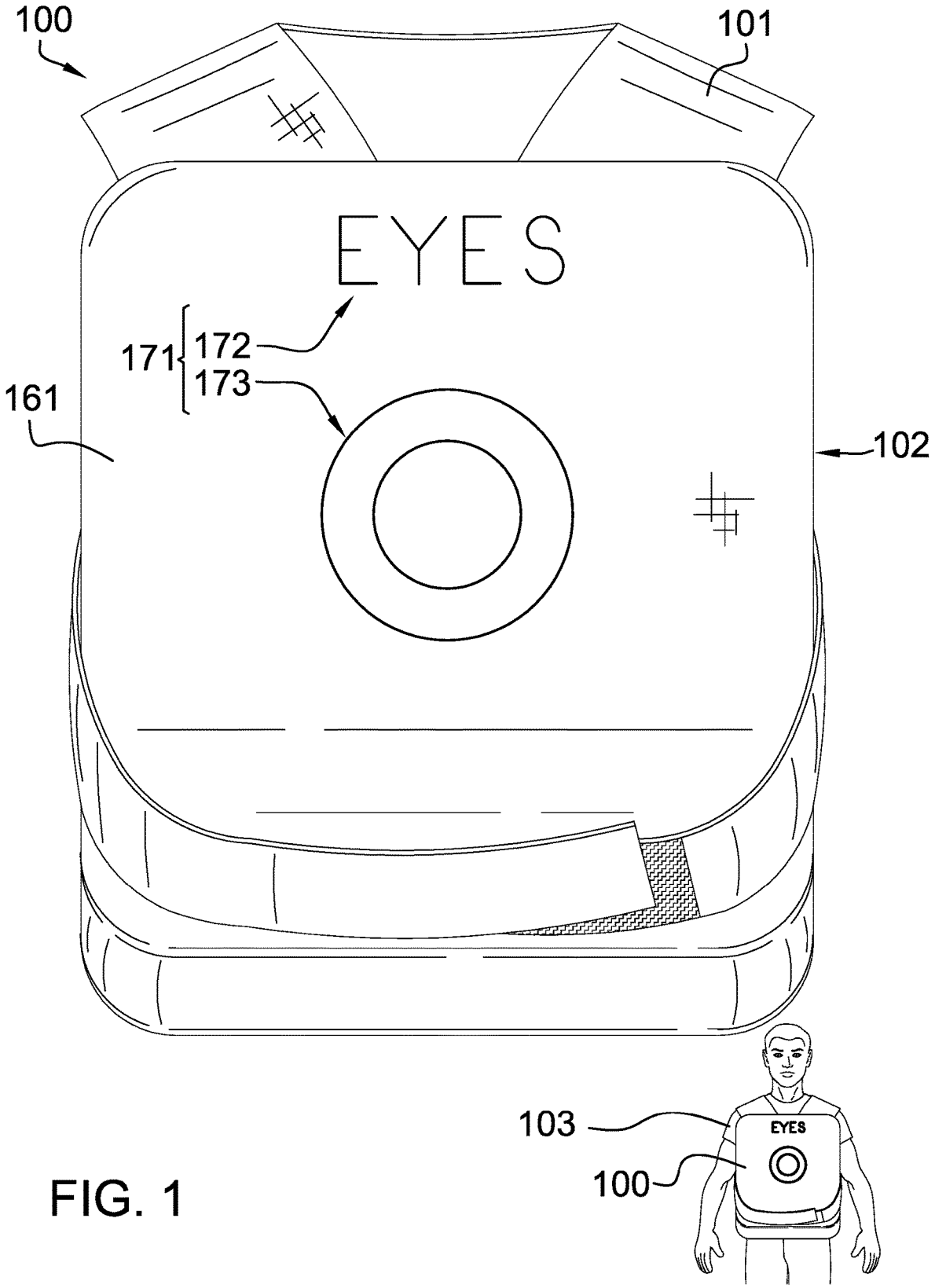
FIG. 1 is a front view of an embodiment of the disclosure.
Figure 2:
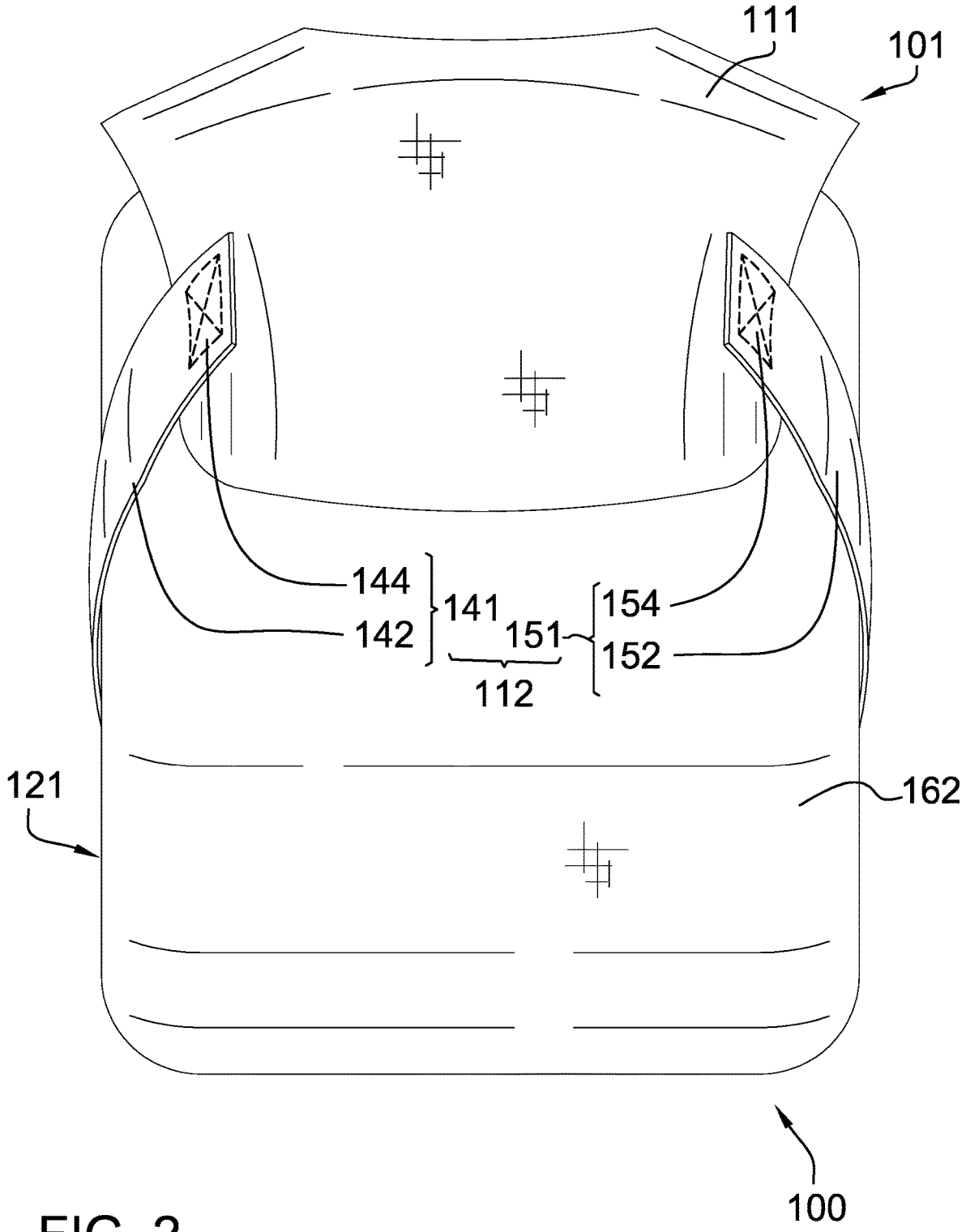
FIG. 2 is a front view of an embodiment of the disclosure.
Figure 3:
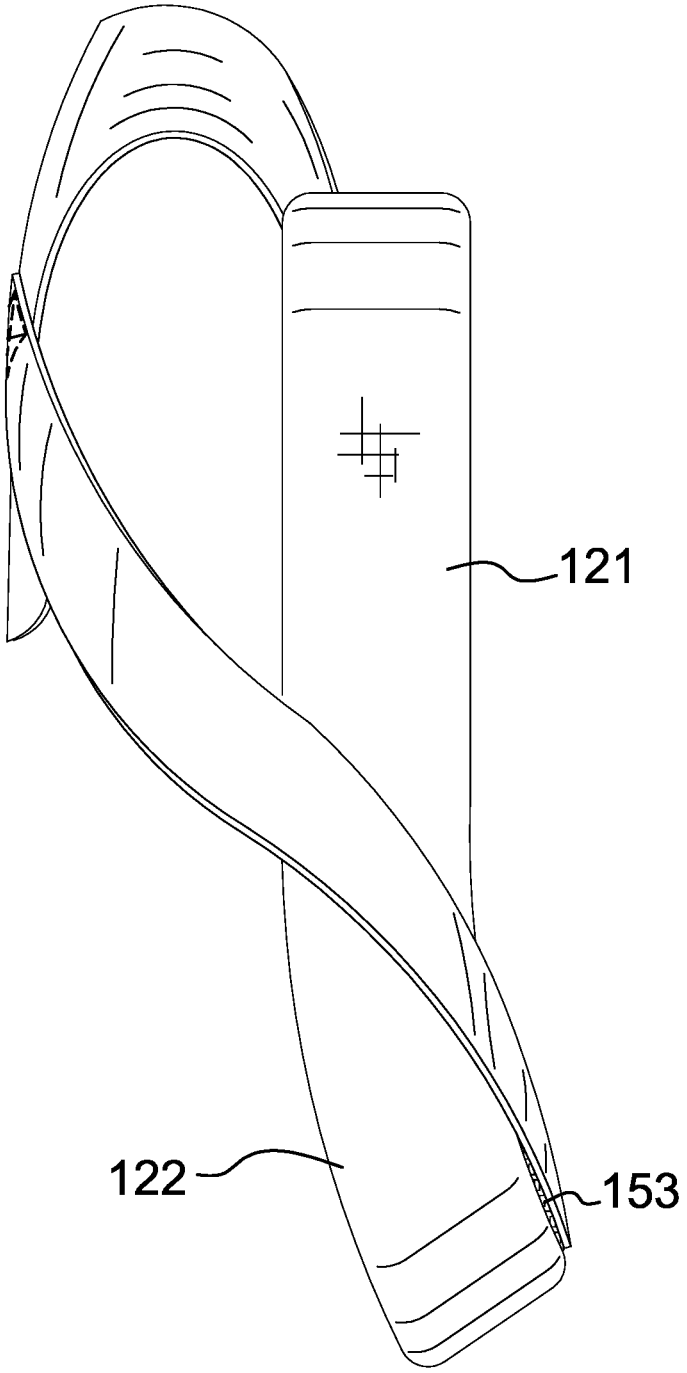
FIG. 3 is a side view of an embodiment of the disclosure.
Figure 4:
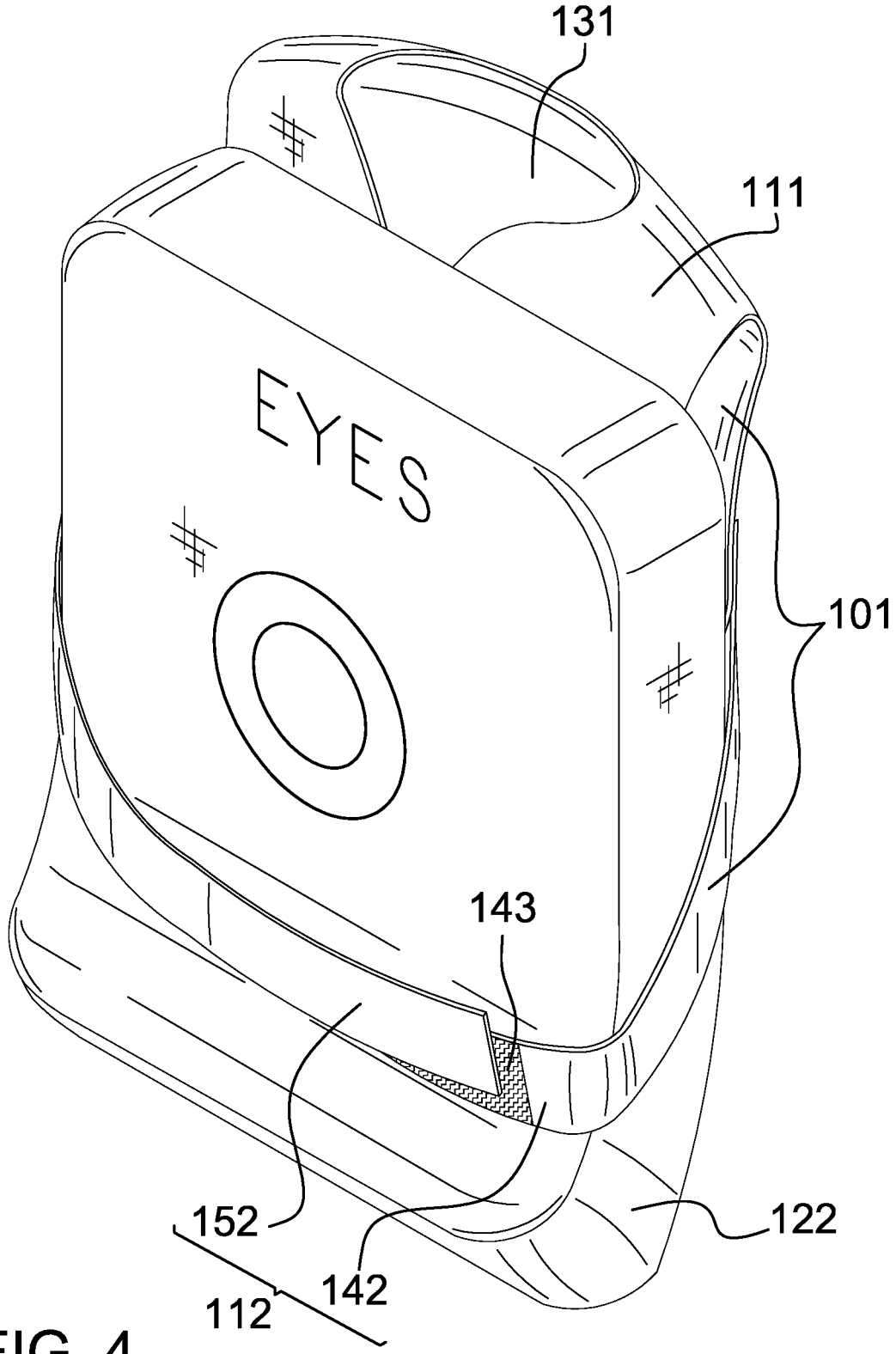
FIG. 4 is a perspective view of an embodiment of the disclosure.

Detailed reference will now be made to one or more potential embodiments of the disclosure, which are illustrated in FIGS. 1 through 4.

The football player-worn target pad 100 (hereinafter invention) is a training device. The invention 100 is a garment. The invention 100 is worn by an athlete 103. The invention 100 is configured for use in training for the game of American football. The athlete 103 is a participant in the training activities for the game of American football. The invention 100 provides targets used to aim the interpersonal impacts that commonly occur between a first athlete 103 and a second athlete 103 participating in American football. The invention 100 comprises a harness structure 101 and a pad structure 102. The harness structure 101 is worn by the first athlete 103. The pad structure 102 presents a plurality of target images 171 that are visible to the second athlete 103. The second athlete 103 aims at the plurality of target images 171 during the interpersonal impact between the second athlete 103 and the first athlete 103.

The pad structure 102 is an elastic structure. The pad structure 102 is a disk shaped structure. The pad structure 102 is formed as a non-Euclidean disk. The harness structure 101 suspends the pad structure 102 from the shoulders of the first athlete 103 such that the pad structure 102 is suspended over the anterior chest region of the torso of the first athlete 103. The pad structure 102 visibly displays the plurality of target images 171 that are aimed at by the second athlete 103 in preparation for the interpersonal impact between the second athlete 103 and the first athlete 103. The elastic nature of the pad structure 102 forms a cushion that absorbs the exchange of momentum between the second athlete 103 and the first athlete 103 during the interpersonal impact between the second athlete 103 and the first athlete 103. The pad structure 102 comprises a protective pad 121 and a concave flare 122.

The protective pad 121 is the non-Euclidean disk shaped structure of the pad structure 102. The protective pad 121 is the elastic structure of the pad structure 102. The protective pad 121 forms the elastic structure that absorbs the exchange of momentum between the interpersonal impact between the second athlete 103 and the first athlete 103. The protective pad 121 forms the structure that displays the plurality of target images 171. The protective pad 121 comprises an anterior face 161, a posterior face 162, and a plurality of target images 171.

The posterior face 162 is the face of the non-Euclidean disk structure of the protective pad 121 with the greatest surface area. The posterior face 162 is the face of the protective pad 121 that is proximal to the first athlete 103. The anterior face 161 is the face of the protective pad 121 that is distal from the posterior face 162. The anterior face 161 is the face of the protective pad 121 that displays the plurality of target images 171.

Each target image selected from the plurality of target images 171 presents a target that is aimed at by the second athlete 103 during the interpersonal impact between the second athlete 103 and the first athlete 103. By properly aiming at each plurality of target images 171, the second athlete 103 learns the proper technique to initiate the interpersonal impact between the second athlete 103 and the first athlete 103. The plurality of target images 171 further comprises a focal point indicia 172 and an impact point indicia 173.

The focal point indicia 172 is a target image selected from the plurality of target images 171. The focal point indicia 172 presents the target that the second athlete 103 should be looking at as the second athlete 103 initiates the interpersonal impact between the second athlete 103 and the first athlete 103. The impact point indicia 173 is a target image selected from the plurality of target images 171. The impact point indicia 173 presents the target that the second athlete 103 should make the impact point as the second athlete 103 initiates the interpersonal impact between the second athlete 103 and the first athlete 103.

The concave flare 122 is a curvature formed in the pad structure 102. The concave flare 122 forms the non-Euclidean portion of the non-Euclidean disk structure of the protective pad 121. The concave flare 122 is located at the inferior surfaces of the protective pad 121. The concave flare 122 is formed such that the anterior face 161 of the protective pad 121 presents a concave surface to the second athlete 103 at the point of interpersonal impact between the second athlete 103 and the first athlete 103. The concave flare 122 provides tactile feedback to the second athlete 103 regarding the effectiveness of the interpersonal impact between the second athlete 103 and the first athlete 103.

The harness structure 101 is a harness. The harness structure 101 secures the invention 100 to the first athlete 103. The harness structure 101 suspends the harness structure 101 from the shoulders of the athlete 103. The harness structure 101 comprises a suspension sheeting 111 and a plurality of fastening belts 112.

The suspension sheeting 111 is a sheeting. The suspension sheeting 111 is worn around the neck of the first athlete 103. The suspension sheeting 111 secures the pad structure 102 to the first athlete 103 such that the pad structure 102 is suspended over the anterior chest region of the torso of the first athlete 103. The suspension sheeting 111 further comprises a neck aperture 131. The neck aperture 131 is an aperture that is formed through the suspension sheeting 111 of the harness structure 101. The neck aperture 131 secures the neck aperture 131 to the first athlete 103. The neck aperture 131 is sized such that the head and the neck of the first athlete 103 insert through the neck aperture 131.

Each fastening belt selected from the plurality of fastening belts 112 is a belt. The plurality of fastening belts 112 temporarily bind the pad structure 102 to the torso of the first athlete 103. Each fastening belt selected from the plurality of fastening belts 112 attaches to the pad structure 102. The plurality of fastening belts 112 temporarily bind to each other to bind the pad structure 102 to the first athlete 103. The plurality of fastening belts 112 comprises a left side fastening belts 141 and a right side fastening belts 151.

The left side fastening belts 141 is a textile based structure. The left side fastening belts 141 permanently attaches to the left side of the protective pad 121. The left side fastening belts 141 wraps around the torso of the first athlete 103. The left side fastening belts 141 detachably attaches to the right side fastening belts 151 to temporarily bind the protective pad 121 to the first athlete 103. The left side fastening belts 141 comprises a left side webbing 142, a left side hook/loop surface 143, and a left side seam 144.

The left side webbing 142 is a webbing. The left side webbing 142 forms the flexible structure of the left side fastening belts 141. The left side webbing 142 forms a portion of the load bearing structure that binds the protective pad 121 to the first athlete 103. The left side seam 144 is a sewn seam. The left side seam 144 permanently attaches the left side webbing 142 to the left side of the protective pad 121. The left side hook/loop surface 143 is a hook/loop surface. The left side hook/loop surface 143 attaches to a face of the left side webbing 142. The left side hook/loop surface 143 attaches to the edge of the left side webbing 142 that is distal from the left side seam 144. The left side hook/loop surface 143 removably attaches the left side webbing 142 to the right side webbing 152 to bind the protective pad 121 to the first athlete 103.

The right side fastening belts 151 is a textile based structure. The right side fastening belts 151 permanently attaches to the right side of the protective pad 121. The right side fastening belts 151 wraps around the torso of the first athlete 103. The right side fastening belts 151 detachably attaches to the left side fastening belts 141 to temporarily bind the protective pad 121 to the first athlete 103. The right side fastening belts 151 comprises a right side webbing 152, a right side hook/loop fastener 153, and a right side seam 154.

The right side webbing 152 is a webbing. The right side webbing 152 forms the flexible structure of the right side fastening belts 151. The right side webbing 152 forms a portion of the load bearing structure that binds the protective pad 121 to the first athlete 103. The right side seam 154 is a sewn seam. The right side seam 154 permanently attaches the right side webbing 152 to the right side of the protective pad 121. The right side hook/loop fastener 153 is a hook/loop surface. The right side hook/loop fastener 153 attaches to a face of the right side webbing 152. The right side hook/loop fastener 153 attaches to the edge of the right side webbing 152 that is distal from the right side seam 154.

The right side hook/loop fastener 153 removably attaches the right side webbing 152 to the left side webbing 142 to bind the protective pad 121 to the first athlete 103. The right side hook/loop fastener 153 presses into the left side hook/loop surface 143 to form a hook and loop fastener that secures the right side webbing 152 to the left side webbing 142 to bind the protective pad 121 to the first athlete 103.

The following definitions were used in this disclosure:

Abdomen: As used in this disclosure, the abdomen refers to the portion of the torso between the bottom of the rib cage and the hips of the person.

Aim and Target (Objects): As used in this disclosure, the words aim and target are related and are defined together. The word aim means to select the course of the movement of a first object along a path. The target is a second object that lies on the route of the first object such that such that an impact will occur between the first object and the second object. Always use Course, Impact, Route, Path, and Momentum Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anterior: As used in this disclosure, anterior is a term that is used to refer to the front side or direction of a structure. When comparing two objects, the anterior object is the object that is closer to the front of the structure.

Belt: As used in this disclosure, a belt is a strip of flexible material that is worn around the torso. The belt is typically worn over the waist and lumbar regions of the torso.

Bind: As used in this disclosure, to bind is a verb that means to tie or secure a first object to a second object using a strap, cord, or webbing. Bind can also mean to tie or secure a plurality of similar first objects together by wrapping a second object around the plurality of similar first objects.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Chest: As used in this disclosure, the chest refers to the region of the torso that is superior to the abdomen.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Concave: As used in this disclosure, concave is used to describe: 1) a surface that resembles the interior surface of a sphere; or, 2) a function with a curvature structure wherein a chord that connects any two points of the function will be lesser than (graphically below) or equal to the value of the function at any point along the chord.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Convex: As used in this disclosure, convex is used to describe: 1) a surface that resembles the outer surface of a sphere; or, 2) a function with a curvature structure wherein a chord that connects any two points of the function will be greater than (graphically above) or equal to the value of the function at any point along the chord.

Correspond: As used in this disclosure, the term correspond is used as a comparison between two or more objects wherein one or more properties shared by the two or more objects match, agree, or align within acceptable manufacturing tolerances.

Course: As used in this disclosure, a course refers to the direction, and changes to the direction, that are required to travel from a starting point to a destination point.

Cushion: As used in this disclosure a cushion is a structure formed with a pad that is used to prevent injury or damage to a person or object.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Distal: As used in this disclosure, distal refers to a directional sense or location of an object. Specifically, distal refers to a first object, or a side of a first object, that is distal from the medial axis, or more proximal to the side of the object, relative to a second object, or side of a second object.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Elastic Nature: As used in this disclosure, an elastic nature refers to a flexible structure that returns to its relaxed shape after the flexible structure has been deformed.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Energy: As used in this disclosure, the energy is a term used in physics. Energy refers to the ability of a system to do work. Energy is a conserved property of a system. Energy is a quantifiable and is generally expressed in units of Joules.

Euclidean Surface: As used in this disclosure, a Euclidean surface refers to a two-dimensional plane that is formed without a curvature. By without a curvature is meant that the shortest distance between any two points on a Euclidean surface forms a line that remains on the Euclidean surface.

Exterior: As used in this disclosure, the exterior is used as a relational term that implies that an object is not contained within the boundary of a structure or a space.

Flexible: As used in this disclosure, flexible refers to an object or material that will deform when a force is applied to it but that will not necessarily return to its original shape when the deforming force is removed.

Force: As used in this disclosure, a force refers to a net (or unopposed) measurable interaction that changes the direction of motion of an object, the velocity of motion of an object, the momentum of an object, or the stress within an object. The term work refers to a measure of the amount of energy that is transferred through the application of a force over a distance. The term power refers to a measure of the amount of energy that is transferred over a period of time.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Garment: As used in this disclosure, a garment is a textile based structure that is used to cover an individual. Clothes, clothing, and apparel are synonyms for garment.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Harness: As used in this disclosure, a harness is an apparatus comprising a plurality of straps and one or more fasteners that is used to fasten or anchor a first person or first object to a second object. The phrase N point harness refers to the installation of the harness wherein the harness has N anchor points. For example, a 2 point harness has two anchor points while a 5 point harness has 5 anchor points.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface. A note on usage: when fastening two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook and loop fastener or the loop surface of a hook and loop fastener is attached to an object this will simply be referred to as the "hook/loop surface" with the understanding that when the two objects are fastened together one of the two objects will have a hook surface and the remaining object will have the loop surface.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Image: As used in this disclosure, an image is an optical representation or reproduction of an indicia or of the appearance of something or someone. See indicia sentiment optical character recognition.

Impact: As used in this disclosure, an impact refers to an exchange of momentum between two objects over a duration. An impact often refers to a collision between two objects.

Indicia: As used in this disclosure, the term indicia refers to a set of markings that identify a sentiment. See sentiment.

Inelastic Nature: As used in this disclosure, an inelastic nature refers to a flexible structure that maintains its new shape after the flexible structure has been deformed.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Lateral: As used in this disclosure, the term lateral refers to an axis of an object that is perpendicular in the transverse (posterior to anterior) direction and the sagittal (superior to inferior) direction. The distal surfaces of an object that intersect the lateral axis are often informally referred to as the "sides" of the object. The lateral axis is usually perpendicular to the primary sense of direction of the object. A lateral face refers to the surfaces of a prism structure that run between the congruent ends of the prism. Movement in a lateral direction is often called "sideways" movement.

Left and Right: As used in this disclosure, the terms left and right are directional references associated with an object. The object is further defined with an anterior surface and a posterior surface. The terms left and right are standardized naming conventions for the lateral directions of the object. The terms left and right use the human body for the initial definition of the orientation. Specifically, when a human body is viewed from posterior side towards the anterior side, the left side of the human body is the lateral side of the human body that contains the heart. The right side of the human body is the lateral side of the body that contains the bulk of the liver. The left and right sides of the human body remain unchanged by changes to the direction from which the human body is viewed. The left side of any object is the same side as the left side of the human body when the object is viewed is viewed from posterior side towards the anterior side. The right side of any object is the same side as the right side of the human body when the object is viewed is viewed from posterior side towards the anterior side. The left and right sides of the object remain unchanged by changes to the direction from which the object is viewed.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Medial: As used in this disclosure, medial refers to a directional sense or location of an object. Specifically, medial refers to a first object or a side of a first object that is closer to the medial axis or more distal from the side of the object relative to a second object or side of a second object.

Medial Axis: As used in this disclosure, the medial axis is the center line of an object that is parallel to the sagittal direction. When two objects are compared relative to the medial axis, the object closer to the medial axis is referred to as the medial object and the object distal from the medial axis is referred to as the lateral object.

Momentum: As used in this disclosure, momentum is a measured quantity associated with the mass of a moving object. The momentum of the object equals the mass of the object multiplied by the velocity of the object. The exchange of momentum between two objects is a conserved quantity meaning that the sum of the momentums of the two objects before an exchange of momentum equals the sum of the momentums of the two objects after the exchange.

Neck: As used in this disclosure, the neck refers to the portion of a biological entity that attaches the head of the biological entity to the torso of the biological entity.

Negative Space: As used in this disclosure, negative space is a method of defining an object through the use of open or empty space as the definition of the object itself, or, through the use of open or empty space to describe the boundaries of an object.

Non-Euclidean Disk: As used in this disclosure, a non-Euclidean structure is a disk-shaped structure wherein the congruent end (faces) of the disk structure lies on a non-Euclidean plane.

Non-Euclidean Plane: As used in this disclosure, a non-Euclidean plane (or non-Euclidean surface) is a geometric plane that is formed with a curvature such that: a) two parallel lines will intersect somewhere in the planar surface; or, b) the span of the perpendicular distance between two parallel lines will vary as a function of the position of the plane; or, c) the minimum distance between two points on the non-Euclidean plane as measured along the non-Euclidean plane is greater than the absolute minimum distance between the same two points. In many geometries, the statements (a) and (b) can be considered identical statements. A non-Euclidean plane is said to form a roughly Euclidean surface (or plane) when the span of the minimum distance between two points on the non-Euclidean plane as measured along the non-Euclidean plane is less than or equal to 1.1 times the absolute minimum distance between the same two points.

Non-Euclidean Prism: As used in this disclosure, a non-Euclidean prism is a prism structure wherein the center axis of the prism lies on a non-Euclidean plane or is otherwise formed with a curvature.

Non-Euclidean Structure: As used in this disclosure, a non-Euclidean structure is a structure wherein: a) the non-Euclidean structure is formed with a non-Euclidean plane; b) the non-Euclidean structure has an axis that lies on a non-Euclidean plane or is otherwise formed with a curvature; or, c) a combination of both (a) and (b) above.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pad: As used in this disclosure, a pad is a mass of soft material used as a filling or for protection against damage or injury. Commonly used padding materials include, but are not limited to, polyurethane foam, silicone, a polyester fill often referred to as fiberfill or polystyrene beads often referred to as stuffing beans or as bean bag chair beans.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Path: As used in this structure, a path is a marked or identified route along which an individual or object can travel. A path is often formed as a track, a road, or a trail.

Perimeter: As used in this disclosure, a perimeter is one or more curved or straight lines that bounds an enclosed area on a plane or surface. The perimeter of a circle is commonly referred to as a circumference.

Posterior: As used in this disclosure, posterior is a term that is used to refer to the side of an object that is distal or in the opposite direction of the anterior side. When comparing two items, the posterior item is the item that is distal from the anterior of the object.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Roughly: As used in this disclosure, roughly refers to a comparison between two objects. Roughly means that the difference between one or more parameters of the two compared objects are not significantly different.

Relaxed Shape: As used in this disclosure, a structure is considered to be in its relaxed state when no shear, strain, or torsional forces are being applied to the structure.

Route: As used in this disclosure, a route refers to the course that is taken to travel from a starting point to a destination point.

Seam: As used in this disclosure, a seam is a joining of: 1) a first textile to a second textile; 2) a first sheeting to a second sheeting; or, 3) a first textile to a first sheeting. Potential methods to form seams include, but are not limited to, a sewn seam, a heat bonded seam, an ultrasonically bonded seam, a laser bonded seam, a radio frequency (RF) bonded seam, or a seam formed using an adhesive.

Sewn Seam: As used in this disclosure, a sewn seam a method of attaching two or more layers of textile, leather, or other material through the use of a thread, a yarn, or a cord that is repeatedly inserted and looped through the two or more layers of textile, leather, or other material.

Sentiment: As used in this disclosure, a sentiment refers to a symbolic meaning or message that is communicated through the use of an image, potentially including a text based image.

Shoulder: As used in this disclosure, a shoulder is a rotating structure of a human body that attaches the arm to the torso.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Suspend: As used in this disclosure, to suspend an object means to support an object such that the inferior end of the object does not form a significant portion of the load path of the object.

Torso: As used in this disclosure, the torso refers to the portion of a human body between the neck and the pelvis. The spine is primarily contained within the torso.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An American football player-worn target pad comprising a harness structure and a pad structure;

wherein the harness structure attaches to the pad structure;

wherein the harness structure comprises a suspension sheeting and a plurality of fastening belts;

wherein the suspension sheeting secures the pad structure to the first athlete such that the pad structure is suspended over the anterior chest region of the torso of the first athlete;

wherein the plurality of fastening belts temporarily bind the pad structure to the torso of the first athlete;

wherein the plurality of fastening belts comprises a left side fastening belts and a right side fastening belts;

wherein the left side fastening belts comprises a left side webbing, a left side hook/loop surface, and a left side seam;

wherein the right side fastening belts comprises a right side webbing, a right side hook/loop fastener, and a right side seam;

wherein the pad structure comprises a protective pad and a concave flare;

wherein the concave flare is a curvature formed in the pad structure.

2. The American football player-worn target pad according to claim 1 wherein the American football player-worn target pad is a training device;

wherein the American football player-worn target pad is a garment;

wherein the American football player-worn target pad is worn by an athlete;

wherein the American football player-worn target pad is configured for use in training for the game of American football;

wherein the athlete is a participant in the training activities for the game of American football;

wherein the American football player-worn target pad provides targets used to aim the interpersonal impacts that occur between a first athlete and a second athlete participating in American football.

3. The American football player-worn target pad according to claim 2 wherein the harness structure is a harness;

wherein the harness structure secures the American football player-worn target pad to the first athlete;

wherein the harness structure suspends the harness structure from the shoulders of the athlete;

wherein the harness structure is worn by the first athlete;

wherein the pad structure presents a plurality of target images that are visible to the second athlete;

wherein the second athlete aims at the plurality of target images during the interpersonal impact between the second athlete and the first athlete.

4. The American football player-worn target pad according to claim 3 wherein the protective pad is the non-Euclidean disk shaped structure of the pad structure;

wherein the protective pad is the elastic structure of the pad structure;

wherein the protective pad forms the elastic structure that absorbs the exchange of momentum between the interpersonal impact between the second athlete and the first athlete;

wherein the protective pad forms the structure that displays the plurality of target images;

wherein the concave flare forms the non-Euclidean portion of the non-Euclidean disk structure of the protective pad;

wherein the concave flare is located at the inferior surfaces of the protective pad;

wherein the concave flare is formed such that the anterior face of the protective pad presents a concave surface to the second athlete at the point of interpersonal impact between the second athlete and the first athlete;

wherein the concave flare provides tactile feedback to the second athlete regarding the effectiveness of the interpersonal impact between the second athlete and the first athlete.

5. The American football player-worn target pad according to claim 4 wherein the protective pad comprises an anterior face, a posterior face, and a plurality of target images;

wherein the posterior face is the face of the non-Euclidean disk structure of the protective pad with the greatest surface area;

wherein the posterior face is the face of the protective pad that is proximal to the first athlete;

wherein the anterior face is the face of the protective pad that is distal from the posterior face;

wherein the anterior face is the face of the protective pad that displays the plurality of target images.

6. The American football player-worn target pad according to claim 5 wherein each target image selected from the plurality of target images presents a target that is aimed at by the second athlete during the interpersonal impact between the second athlete and the first athlete;

wherein by properly aiming at each plurality of target images, the second athlete learns the proper technique to initiate the interpersonal impact between the second athlete and the first athlete;

wherein the plurality of target images further comprises a focal point indicia and an impact point indicia;

wherein the focal point indicia is a target image selected from the plurality of target images;

wherein the focal point indicia presents the target that the second athlete should be looking at as the second athlete initiates the interpersonal impact between the second athlete and the first athlete;

wherein the impact point indicia is a target image selected from the plurality of target images;

wherein the impact point indicia presents the target that the second athlete should make the impact point as the second athlete initiates the interpersonal impact between the second athlete and the first athlete.

7. The American football player-worn target pad according to claim 6 wherein the suspension sheeting is a sheeting;

wherein the suspension sheeting is worn around the neck of the first athlete;

wherein the suspension sheeting further comprises a neck aperture;

wherein the neck aperture is an aperture that is formed through the suspension sheeting of the harness structure;

wherein the neck aperture secures the neck aperture to the first athlete;

wherein the neck aperture is sized such that the head and the neck of the first athlete insert through the neck aperture.

8. The American football player-worn target pad according to claim 7 wherein each fastening belt selected from the plurality of fastening belts is a belt;

wherein each fastening belt selected from the plurality of fastening belts attaches to the pad structure;

wherein the plurality of fastening belts temporarily bind to each other to bind the pad structure to the first athlete.

9. The American football player-worn target pad according to claim 8 wherein the left side fastening belts is a textile based structure;

wherein the left side fastening belts permanently attaches to the left side of the protective pad;

wherein the left side fastening belts wraps around the torso of the first athlete;

wherein the left side fastening belts detachably attaches to the right side fastening belts to temporarily bind the protective pad to the first athlete;

wherein the right side fastening belts is a textile based structure;

wherein the right side fastening belts permanently attaches to the right side of the protective pad;

wherein the right side fastening belts wraps around the torso of the first athlete;

wherein the right side fastening belts detachably attaches to the left side fastening belts to temporarily bind the protective pad to the first athlete.

10. The American football player-worn target pad according to claim 9 wherein the left side webbing is a webbing;

wherein the left side webbing forms the flexible structure of the left side fastening belts;

wherein the left side webbing forms a portion of the load bearing structure that binds the protective pad to the first athlete;

wherein the left side seam is a sewn seam;

wherein the left side seam permanently attaches the left side webbing to the left side of the protective pad;

wherein the left side hook/loop surface is a hook/loop surface;

wherein the left side hook/loop surface attaches to a face of the left side webbing;

wherein the left side hook/loop surface attaches to the edge of the left side webbing that is distal from the left side seam;

wherein the left side hook/loop surface removably attaches the left side webbing to the right side webbing to bind the protective pad to the first athlete.

11. The American football player-worn target pad according to claim 10 wherein the right side webbing is a webbing;

wherein the right side webbing forms the flexible structure of the right side fastening belts;

wherein the right side webbing forms a portion of the load bearing structure that binds the protective pad to the first athlete;

wherein the right side seam is a sewn seam;

wherein the right side seam permanently attaches the right side webbing to the right side of the protective pad;

wherein the right side hook/loop fastener is a hook/loop surface;

wherein the right side hook/loop fastener attaches to a face of the right side webbing;

wherein the right side hook/loop fastener attaches to the edge of the right side webbing that is distal from the right side seam.

* * * * *